United States Patent [19]

Urion

[11] 4,245,536

[45] Jan. 20, 1981

[54] HINGED CUTTER TRACK

[75] Inventor: Kenard E. Urion, Woodbury, N.J.

[73] Assignee: Scott Paper Company, Philadelphia, Pa.

[21] Appl. No.: 68,182

[22] Filed: Aug. 20, 1979

[51] Int. Cl.[3] ..... B26D 1/04; B26D 7/00

[52] U.S. Cl. ..... 83/821; 83/614; 83/649

[58] Field of Search ..... 83/821, 614, 649, 455, 83/175, 374

[56] References Cited

U.S. PATENT DOCUMENTS

| | | | |
|---|---|---|---|
| 3,142,217 | 7/1964 | Busse | 83/455 |
| 3,236,427 | 2/1966 | Martin | 83/614 X |
| 4,197,774 | 4/1980 | Singh et al. | 83/455 X |

*Primary Examiner*—Frank T. Yost

*Attorney, Agent, or Firm*—Martin L. Faigus; William J. Foley

[57] ABSTRACT

A hinged article, preferably in the form of a track (10) for slidably retaining a cutter slide (12) therein, includes first and second sections (18 and 20) joined together at a hinged region (22 and 24); said first and second sections having channel segments (28 and 30) communicating with each other to permit movement of an element, such as cutter slide (12), between them when the sections (18 and 20) are in a first orientation relative to each other; at least one stop (e.g. 34) formed in the article adjacent the hinged region for intercepting a channel segment (28) when the first and second sections (18 and 20) of the article (10) are in a second orientation relative to each other.

10 Claims, 8 Drawing Figures

HINGED CUTTER TRACK

TECHNICAL FIELD

This invention relates to a hinged article, and more particularly to a hinged track of a cutter assembly that is adapted to be secured to a box from which sheet or web material is dispensed for cutting.

BACKGROUND ART

It is often desirable to package sheet material in roll form, and to provide a cutting mechanism as part of the package for severing the sheet material into desired lengths, depending upon intended use. It is quite common to package the rolls in boxes that are intended to be disposed of after the rolls have been depleted. Obviously any cutting mechanism employed as part of such a disposable box construction must be sufficiently economical to manufacture to justify its disposal along with the box.

A highly reliable and economically constructed cutter assembly is disclosed in copending application Ser. No. 959,853, filed on Nov. 9, 1978, now U.S. Pat. No. 4,210,043 and entitled *CUTTING ASSEMBLY AND METHOD OF FORMING A TRACK THEREOF.* The assembly covered in the '853 application includes an elongate track adhesively secured to an elongate box in which a roll of web or sheet material is packaged. A cutter slide is mounted for movement within the track, and the track includes both an active or cutting section, aligned with the web dispensing slot for receiving the web material to be cut over it, and an inactive, or storage section, extending axially beyond the web dispensing slot. To initiate the dispensing operation the cutter slide is positioned in the inactive section of the track as the web material is being fed out of the dispensing slot. Thereafter, when the desired length of material overlies the cutting section of the track, the cutter slide is moved across the web to sever it. In this construction the axial length of the box must be sufficient to accommodate both the cutting and storage sections of the track.

To maximize the number of boxes that can be displayed in a given shelf space it is very desirable to minimize the axial length of the box. This invention is an improvement over that covered in the above-referenced '853 application, and includes features which permit a reduction in the axial length of the box, as will be described hereinafter.

DISCLOSURE OF INVENTION

In accordance with this invention a hinged article includes first and second sections joined together at a hinged region; said first and second sections having channel segments communicating with each other to permit movement of an element between them when said sections are in a first orientation relative to each other; at least one stop adjacent the hinged region for intercepting a channel segment when said first and second sections are moved at the hinged region into a second orientation relative to each other, whereby said stop will prevent movement of the element out of the channel segment it intercepts.

In the preferred form of the invention the hinged article is an elongate track adapted to accommodate a cutter slide within a slot thereof, and also adapted to be secured to a box containing a roll of web material to be cut into desired lengths. The track includes an active, or cutting section, aligned with a web dispensing slot in the box, and an inactive, or storage section positioned beyond the dispensing slot.

In accordance with this invention the track is hinged between the cutting and storage sections to permit the storage section to be pivoted into overlying relationship with an end wall of the package (i.e. stored position). Therefore, the axial length of the package can be minimized by eliminating the axial section which heretofore was necessary to accommodate the storage section of the track.

When the storage section of the track is pivoted to overlie an end wall of the package, it opens up the ends of channel, or slot segments of the storage section and cutting section of the track adjacent the hinged region. In order to prevent the cutter slide from escaping from the open ends of these channel segments a pair of stops preferably are integrally formed with the track, and are actuated to intercept the open ends of the channel segments upon pivoting of the storage segment into its stored position overlying the end wall of the package. Thus, pivoting the track into its stored position will automatically cause the stops to intercept the opened ends of the channel segments to prevent the cutter slide from escaping, regardless of whether the slide is in the cutting or storage sections of the track.

It is within the scope of this invention to provide one or more stops that, upon pivoting of the storage section of the track into its stored position, will intercept the open end of only one of the channel segments adjacent the hinge line. In this embodiment it is preferred that the stop(s) intercept the open end of the channel segment associated with the storage section of the track, and that the cutter slide be moved into the storage section prior to pivoting the storage section into its stored position. In order to maintain the storage end of the track in its stored position a suitable mechanical or adhesive fastening system can be provided. When an adhesive is employed it can be included either on the surface of the end wall of the package, or directly on the storage section of the track.

BEST MODE FOR CARRYING OUT THE INVENTION

Figure 1:
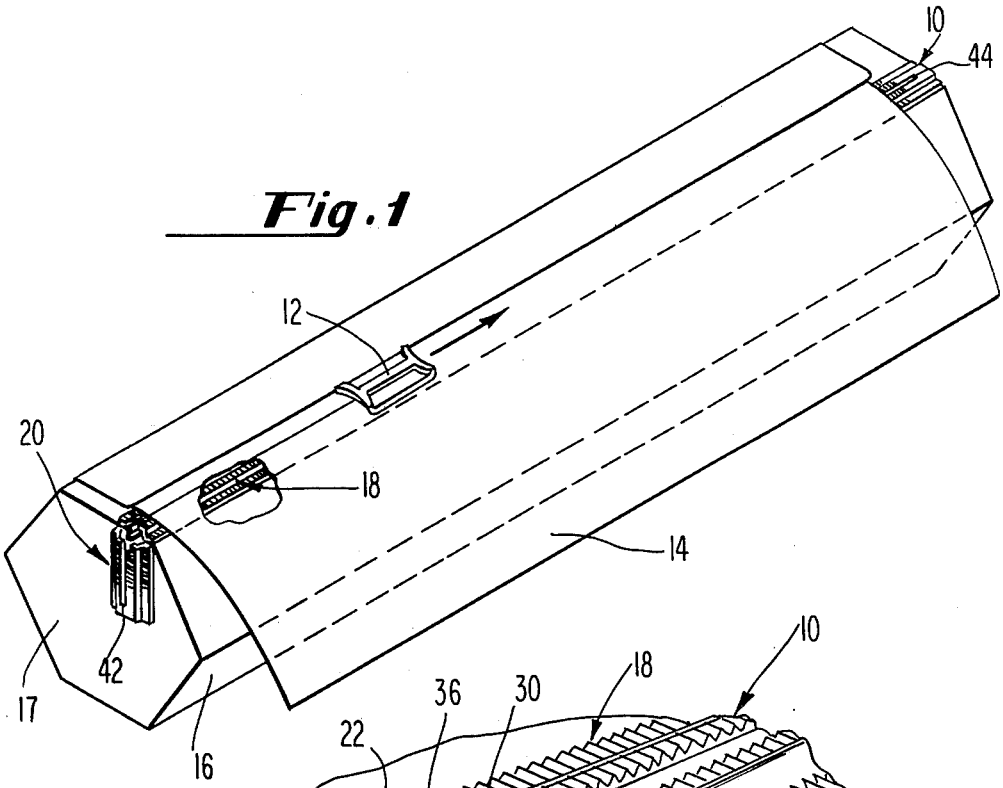
FIG. 1 is an isometric view showing the hinged track of the invention mounted on a box in which sheet material to be cut is packaged; preferably in roll form.

Referring to FIG. 1, a track 10 of this invention slidably retains a cutter slide 12 with it. In the illustrated embodiment the cutter slide is employed to sever a sheet or web 14 packaged in roll form within a box 16 to which the track is attached.

The track 12, except for the hinge and stop arrangement to be subsequently described, can be identical to that disclosed in earlier-referenced patent application Ser. No. 959,853, invented by Kenard E. Urion, and filed on Nov. 9, 1978. In fact, the track 10 preferably is molded as a single unit in substantially the same manner as disclosed in the '853 patent, but with the inclusion of a "shut-off" in the mold to provide the interruption in the bottom wall that forms the stop arrangement. The cutter slide 12 also can be identical to that described in the '853 patent application. The '853 application is herein incorporated by reference.

Figure 2:
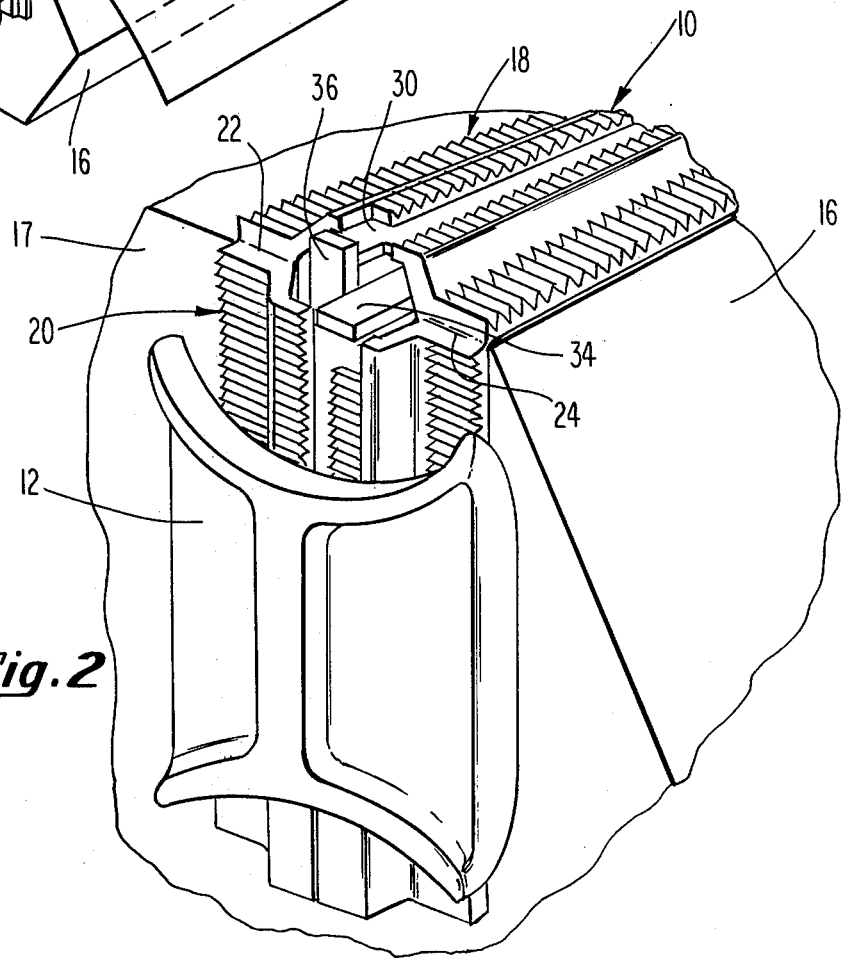
FIG. 2 is a fragmentary isometric view of the hinged track of the invention showing the storage section in its stored position.
Figure 3:
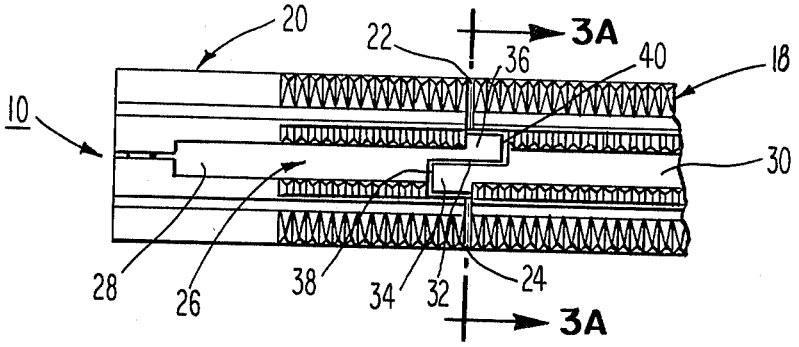
FIG. 3 is a plan view of the hinged track of this invention with the storage section in linear alignment with the cutting section.

Referring specifically to FIGS. 2 and 3, the track 10 of this invention includes an active, or cutting section 18 separated from an inactive, or storage section 20 by thin, linearly-aligned hinged regions 22 and 24. These hinged regions are formed on opposite sides of a channel 26 in which the cutter slide is retained, and this channel is divided into a segment 28 associated with the storage section 20, and a segment 30 associated with the cutting section 18.

Figure 3A:
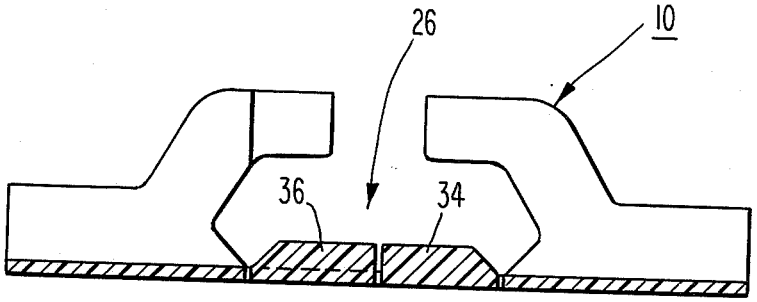
FIG. 3A is a sectional view along lines 3A—3A illustrating the continuity of the channel when the track is oriented as shown in FIG. 3.

As can be seen in FIGS. 3 and 3A, the channel segments 28 and 30 are in continuous communication with each other when the storage section 20 is positioned in linear, or axial alignment with the cutting section 18. In this position, the cutter slide 12 can be moved between the cutting and storage sections, as desired.

Referring again to FIGS. 3 and 3A, the bottom wall of the channel is interrupted in a stepped configuration 32. This forms a pair of stops 34 and 36 that are adapted to intercept the channel segments 28 and 30, respectively, in a manner which will be described hereinafter. In the embodiment shown in FIG. 3 the hinged regions 22 and 24 are aligned with each other intermediate the free ends 38 and 40 of the stops 34 and 36. In other words, the stop 34 extends to the left of the hinged regions; terminating in free end 38, and the stop 36 extends to the right of the hinged regions; terminating in free end 40.

As can be seen best in FIG. 2, when the inactive, or storage section 20 of the track is moved into its stored position overlying an end wall 17 of the box 16, the stops 34 and 36 automatically are positioned to intercept the channel segments 28 and 30, respectively. The storage section 20 is positioned in overlying relationship with the end wall 17 of the box 16 when the product is packaged for sale, or storage. If desired, the lower surface of the storage section 20 can be provided with a releaseable adhesive layer to positively retain the storage section in engagement with the end wall 17. Alternatively, the adhesive layer can be provided directly on the end wall, or a mechanical fastening system associated with both the end wall and storage section can be employed.

The cutter slide 12 cannot escape from the channel 26 when the storage and cutting section 20 and 18 thereof are axially aligned with each other (e.g. see FIG. 3). This results from the fact that the channel is closed at its opposite ends 42 and 44 (FIG. 1), as is described in greater detail in copending application Ser. No. 959,853. When the storage section 20 is pivoted into its stored position the stops 34 and 36 automatically will be moved into intercepting relationship with the channel segments 28 and 30 to prevent the cutter slide from escaping from the channel segment in which it is retained. Most preferably the cutter slide 12 is moved into the storage section 20 of the track prior to moving the storage section into its stored position. However, even if the user inadvertently fails to move the cutter slide into the storage section 20, the arrangement disclosed in FIGS. 1–3 will prevent separation of the cutter slide from the track 10.

Figure 4:
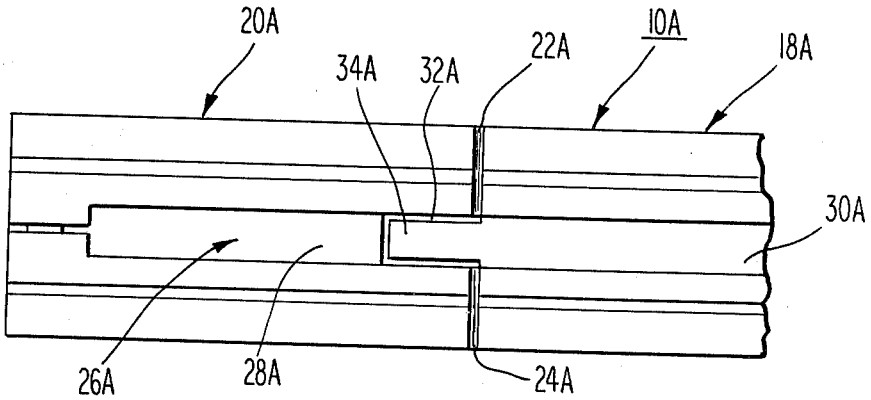
FIG. 4 is a somewhat schematic, fragmentary plan view showing an alternative embodiment of the track of this invention.
Figure 5:
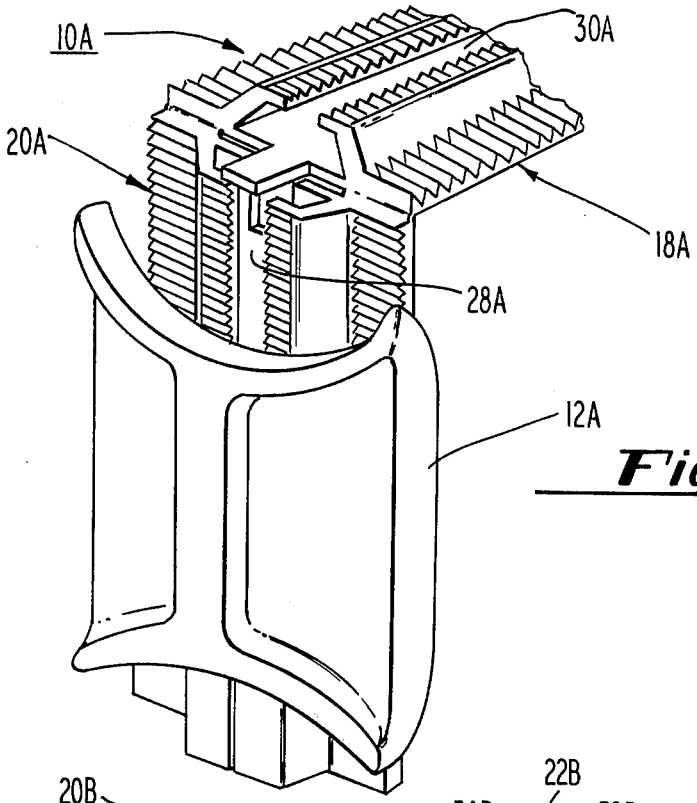
FIG. 5 is a fragmentary, isometric view of the track shown in FIG. 4 with its storage section in stored position.

Referring to FIGS. 4 and 5, a second embodiment of a track 10A is shown, wherein only a single stop 34A is provided. The stop 34A is provided by an interruption 32A in the base of channel 26A. The interruption is provided so that the stop 34A extends to the left of linearly aligned hinged regions 22A–24A, as viewed in FIG. 4. As can be seen best in FIG. 5, the stop 34A will intercept the channel segment 28A associated with the storage section 20A when said storage section is in its stored position.

For purposes of clarity the V-shaped grooves forming a part of the preferred track construction, as illustrated in FIG. 5, have been omitted from the FIG. 4 view. The function of the various grooves is described in detail in the '853 patent application, and does not form a part of the presented invention.

When the embodiment shown in FIGS. 4 and 5 is used it is important to move the cutter slide 12A into the storage section 20A of the track prior to moving the storage section into its stored position. Otherwise, if the cutter slide 12A is left in cutting section 18A, it can slide out of the open end of the channel segment 30A.

Figure 6:
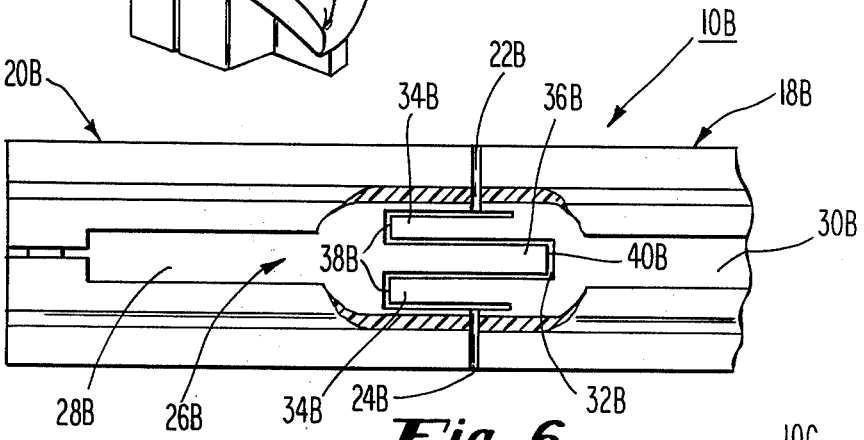
FIG. 6 is a somewhat schematic, fragmentary plan view of a further embodiment of the track of this invention; with parts broken away to show details of construction.

Referring to FIG. 6, an alternative embodiment of a track 10B is shown. In this track a pair of stops 34B extend to the left of axially aligned hinged regions 22B, 24B, and terminate in free ends 38B. A single stop 36B extends to the right of the linearly aligned hinged regions 22B, 24B, and terminates in a free end 40B. In other words the linearly aligned hinged regions 22B–24B are intermediate the free end 40B of the stop 36B and the free ends 38B of the pair of stops 34B. When the inactive, or storage section 20B of the track is bent into its stored position (the position illustrated in FIGS. 1 and 5), the pair of stops 34B will intercept channel segments 28B in the storage section of the track, and the single stop 36B will intercept the channel segment 30B in the cutting section 18B of the track.

If desired the interruption 32B in the base of channel 26B could be reversed to provide a pair of stops for intercepting the channel segment 30B and only a single stop for intercepting the channel segment 28B. Moreover, it is possible to provide the interruption so that multiple stops intercept the open end of each channel segment 28B and 38B when the storage section 20B is moved into its stored position.

Figure 7:
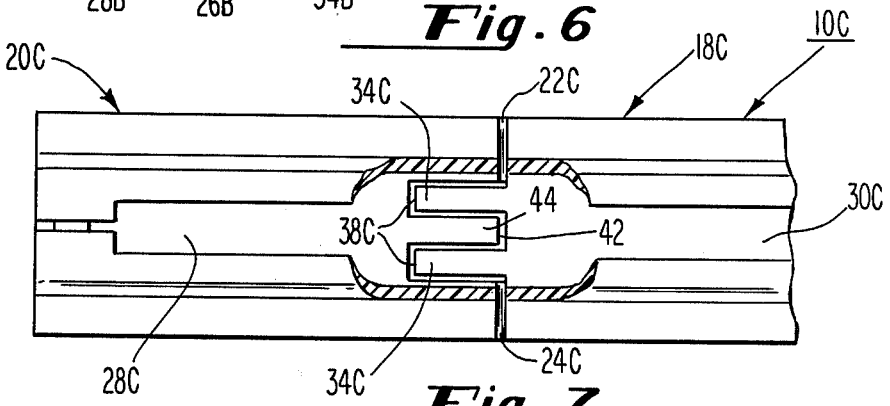
FIG. 7 is a somewhat schematic, fragmentary plan view of still another embodiment of the track of this invention with parts broken away to show details of construction.

Referring to FIG. 7, still another embodiment of a track is designated at 10C. In this embodiment a pair of stops 34C extend to the left of linearly aligned hinged regions 22C and 24C, and terminate in free ends 38C. These two stops, by virtue of extending to the left of the hinged regions, will only intercept the channel segment 28C associated with the storage section 20C of the track when the storage section is in its stored position.

Note that free end 42 of intermediate tab section 44 is linearly aligned with the hinged regions 22C and 24C, and therefore will not intercept the channel segment 30C of the cutting section 18C when the storage section 20C is pivoted into its stored position.

I claim:

1. An article including first and second sections joined together at a hinged region; said first and second sections having channel segments communicating with each other to permit movement of an element between them when said first and second sections are in a first orientation relative to each other; at least one stop adjacent the hinged region for intercepting a channel segment when said first and second sections are in a second orientation relative to each other.

2. The article of claim 1 molded as a single one-piece unit.

3. The article of claim 2 including at least two stops, one of said stops intercepting one channel segment adjacent the hinged region and the other stop intercepting the other channel segment adjacent the hinged region when the first and second sections are in the second orientation.

4. The article of claim 2 wherein said channel segments are formed in part by a wall through which an interruption is provided to form the stops.

5. A track of the type for slidably retaining a cutter slide therein, said track including cutting and storage sections joined together at a hinged region; said cutting and storage sections having channel segments in which the cutter slide is adapted to be slidably retained, said channel segments continuously communicating with each other to permit movement of the cutter slide between them when said cutting and storage segments are in a first orientation with respect to each other; at least one stop for intercepting a channel segment when the storage and cutting sections of the track are in a second orientation relative to each other.

6. The track of claim 5 molded as a single one-piece unit.

7. The track of claim 6 wherein the storage and cutting sections are linearly aligned with each other in the first orientation, and are disposed at an angle to each other in the second orientation.

8. The track of claim 6 including at least one stop formed in the bottom wall of each channel segment.

9. The track of claim 8 including at least two stops formed in the bottom wall of at least one of the channel segments.

10. The track of claim 8 wherein the hinged region is intermediate free ends of the stops formed in the two channel segments.

* * * * *